United States Patent [19]

Jacobs

[11] 4,147,095

[45] Apr. 3, 1979

[54] DIRECTIONAL CONCENTRATED AIR DISCHARGE OUTLET

[76] Inventor: John D. Jacobs, 2708 Merrimac Cir., Waco, Tex. 76710

[21] Appl. No.: 788,994

[22] Filed: Apr. 20, 1977

[51] Int. Cl.[2] ..... F24F 13/14

[52] U.S. Cl. ..... 98/40 VM; 98/40 E; 98/40 N; 98/121 A

[58] Field of Search ..... 98/121 R, 121 A, 40 E, 98/40 VM, 40 D, 33 R, 40 N, 40 A, 36

[56] References Cited

U.S. PATENT DOCUMENTS

| | | | |
|---|---|---|---|
| 1,228,931 | 6/1917 | Kirk | 98/33 R |
| 2,259,780 | 10/1941 | Seid | 98/33 R X |
| 3,385,036 | 5/1968 | Webb | 98/121 R X |
| 3,877,356 | 4/1975 | Bruns | 98/40 D |
| 3,898,921 | 8/1975 | Trube et al. | 98/40 VM X |
| 3,937,133 | 2/1976 | Bertin et al. | 98/121 R X |
| 3,942,419 | 3/1976 | Beach | 98/40 A |

*Primary Examiner*—William E. Wayner
*Assistant Examiner*—William E. Tapolcai
*Attorney, Agent, or Firm*—Schuyler, Birch, Swindler, McKie & Beckett

[57] ABSTRACT

A multi-louvered air discharge device for a forced air ventilation system, capable of focusing a concentrated stream of air from two discharge openings on any point along the perimeter of a hemisphere surrounding the device. The two discharge openings are each equipped with vanes to direct the flow of air issuing therefrom. The sets of vanes are controlled together so that the air issuing from each set is directed toward a predetermined adjustable point by a control system.

7 Claims, 6 Drawing Figures

DIRECTIONAL CONCENTRATED AIR DISCHARGE OUTLET

BACKGROUND OF THE INVENTION

Ceiling diffusers, registers, or air vents that effectively diffuse discharged air into a room are well known. Such diffusers generally employ louvers to diffuse or distribute the discharged air and then rely on convection currents of the like to evenly distribute the discharged air, and hence to condition all of the air within a room. It is often impractical however, especially in an industrial setting, to condition all of the air within a room or factory where environmental extremes of heat or cold are necessarily present.

In such cases, it may be advantageous to direct the air issuing from an outlet to a particular point in the room, where persons are working, for example. If this spot never changes, an outlet can be specifically designed to direct air to that point, and there is no problem. However, this spot quite often changes, when workers move to a new location, conditions within the room change, or the desire of the workers change, and therefore the stream of air must be redirected.

While the prior art contains many outlets, some of them adjustable, it does not present an outlet specifically designed for the above purpose, and presently known outlets fall short of adequately accomplishing this task.

BRIEF SUMMARY OF THE INVENTION

With the foregoing in mind, a primary objective of the present invention is the provision of an air discharge outlet capable of concentrating its delivered air within a relatively small area.

It is a further objective of the present invention to provide a concentrated air discharge outlet which is directionally adjustable, so that the concentrated air current may be directed toward any area within reach of the focused air current.

Still another objective of the present invention is to provide a concentrated air discharge device which may be easily targeted by an operator on floor level using an appropriately designed adjustment tool.

In order to focus and concentrate the discharged air, the outlet of my invention employs a discharge box having an outlet opening on its bottom and another one on the side. Within each opening are a plurality of adjustable louvers or the like, that are pivotally mounted and arranged in parallel. The vanes in each set are parallel, and the two sets are aimed in parallel paths, but the characteristics of discharge cause the airstreams issuing from each to converge and travel toward the same area. The louvers are interconnected by an adjustment linkage, so that the two sets of vanes act together to maintain the focused airstreams even as the area of focus is relocated. As one set of baffles is opened, the other is closed, and thus the total cross-sectional area of discharge opening remains the same. The air discharge device may be directionalized without reducing the total volume of air discharged.

In order to directionalize the discharge of air within the horizontal plane, the air discharge box is rotatably joined to an air inlet trunk of a forced air ventilation system by a rotating collar which enables the discharge box to rotate 360° within the horizontal plane.

By an appropriate adjustment of the louver adjustment linkage a concentrated discharge of air may be directed along any line in a vertical plane through 90° arc from the axis of rotation of the discharge box. Thus, it is apparent that by an appropriate adjustment of the louver linkage and rotation of the discharge box a concentrated column of air may be directed toward any point on the perimeter of a hemisphere beneath the outlet. If the outlet were installed with its axis horizontally oriented, or upon a floor duct, the hemisphere it serves would be suitably reoriented.

BRIEF DESCRIPTION OF THE DRAWINGS

The objectives referred to above, as well as still other objectives and advantages of the present invention, will become more apparent upon reference to the following detailed specification taken in connection with the accompanying drawings in which.

DETAILED DESCRIPTION OF THE DRAWINGS

Figure 6:
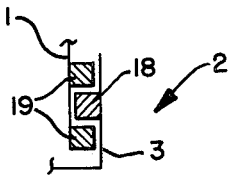
FIG. 6 is a cross-sectional view taken at circle 6 on FIG. 1 of the 360° rotating collar construction.

This invention is shown installed upon a downwardly extending vertically oriented air supply duct 1, although this duct could be upwardly or sidewardly extending. Attached to supply duct 1 by a collar 2 is a discharge box 3. Collar 2 permits full rotation of box 3, and can be like that shown on FIG. 6, described below.

Box 3 is provided with a bottom rectangular outlet 4 and a side rectangular outlet 5. Pivotally mounted in bottom outlet 4 are a plurality of bottom louvers 6, which are rectangular in shape, and which when in the closed position (FIG. 5), substantially completely close outlet 4. Likewise, pivotally installed in outlet 5 are a plurality of side louvers 7, rectangular in shape, which are capable of substantially completely closing outlet 5. Louvers 6 and 7 can be pivotally mounted in any of the well known ways, such as upon shafts 8 extending through openings in the side of the outlets.

Figure 1:
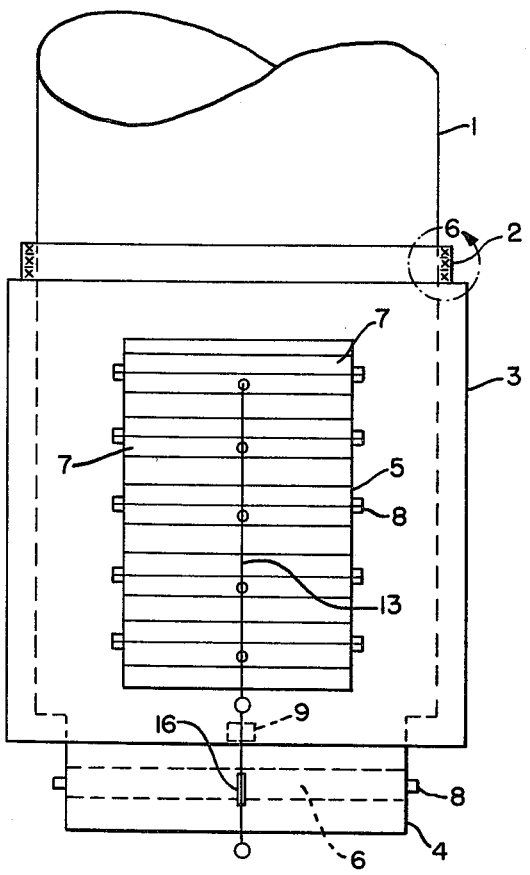
FIG. 1 is a front elevational view of an air outlet constructed in accordance with this invention.
Figure 2:
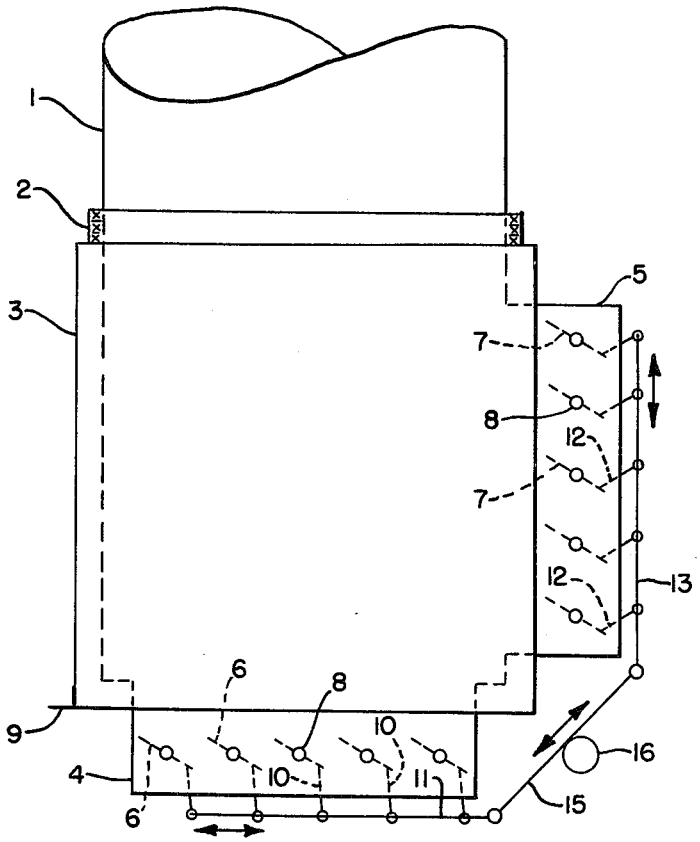
FIG. 2 is a side elevational view of the device of FIG. 1.

Connected to each of louvers 6 and 7 is a mechanism for adjusting the angular position of the sets of louvers. All the louvers in each set are parallel to one another, and are movable together. Many systems of linkages could be used to move the louvers. A single one is illustrated. To each louver 6 is fixedly attached an arm 10. The plurality of arms 10 are pivotally attached to a rod 11. Movement of rod 11 in the direction of the arrows (FIG. 2) causes louvers 6 to be repositioned. Likewise, a plurality of arms 12 are attached to louvers 7, and these in turn are pivotally attached to a rod 13. One end of each of rods 11 and 13 is pivotally joined to an adjustment member 15, to which is attached a ring 16.

Collar 2 is equipped with a sealing means (FIG. 6), such as a box seal 18, flanked by a pair of duct seals 19.

Figure 3:
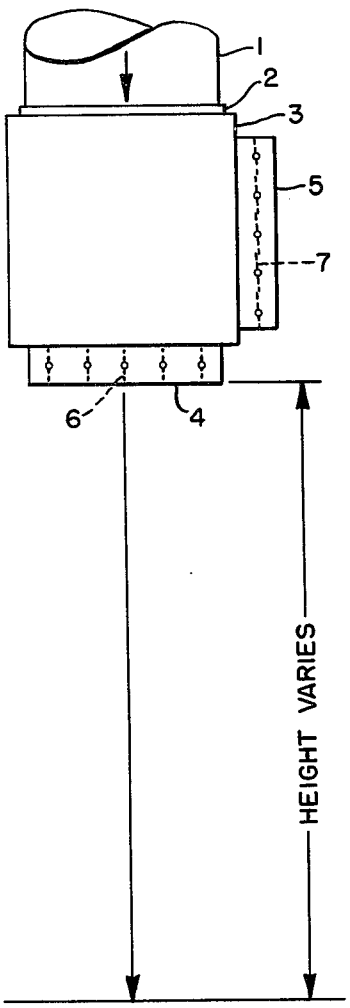
FIG. 3 is a side elevational view showing one extreme operating position of the louvers.
Figure 4:
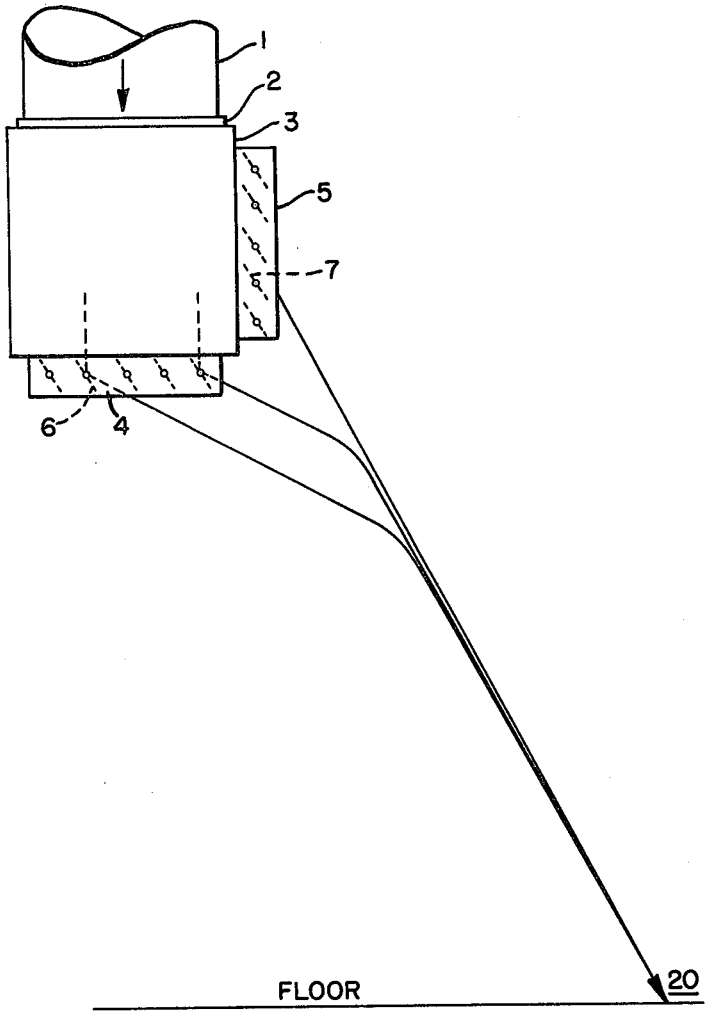
FIG. 4 is a side elevational view showing the two airstreams focused toward a single area.
Figure 5:
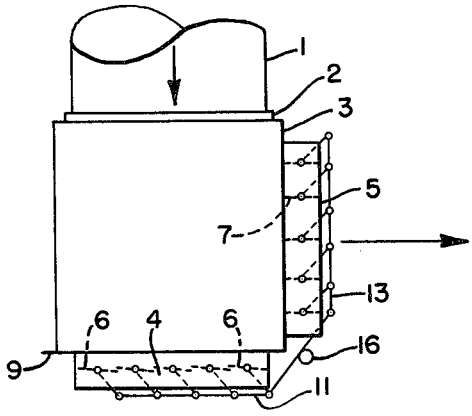
FIG. 5 is a side elevational view showing the other extreme operating position of the louvers.

A set angular relationship is established between the sets of louvers 6 and 7. In the drawings, louvers 6 and 7 are linked so as to be oriented in exactly the same direction. The airstream issuing from outlet 5, subject only to static pressure, departs from louvers 7 in essentially the same direction as the direction of orientation of said louvers. The airstream issuing from outlet 4, having encountered louvers 6 with velocity, departs from louvers 6 at essentially the same angle to said louvers as the angle of encounter between said airstream and louvers 6. The airstream issuing from outlet 4 is thus deflected into the airstream issuing from outlet 5, causing the two airstreams to converge. The resulting merged airstream is thereby essentially focused, in a resultant direction of travel, on a small area 20 (FIG. 4). Factors affecting the angular orientation of the sets of louvers include distance to the focus area and size of focus area. The focus area can be relocated by suitable manipulation of member 15. In one extreme position (FIG. 3), louvers 7 are closed, and louvers 6 are fully open, and therefore all air is directed downwardly. The other extreme is shown in FIG. 5, where all air is directed substantially horizontally, from side outlet 5. Between those two positions, air issues from both outlets, and is directed to the area of focus 20, which is located depending upon the manipulation of member 15. In addition, box 3 can be rotated.

Essentially, the total discharge area is constant. That is, as one set of louvers is opened, the other is closed, so the system pressures are essentially not varied by this system. Operation of member 15 can be accomplished by a wand (not shown) engageable with ring 16.

The inventive system is simple and effective. It provides the user with air directed in a concentrated stream toward a particular area. This focus area can easily be relocated. Other angular relationships of vane 6 and 7 can be established, within the scope of the invention.

Variations and modifications of the above described preferred embodiment may become evident to one skilled in the art upon exposure to this disclosure. However, the scope of the invention is not limited to the preferred embodiment, but is governed only by the appended claims.

I claim:

1. An air discharge device for use with an air supply system comprising:

an outlet box, first and second outlet openings in said outlet box spaced from one another and at a predetermined angle approximately 90° to one another, first and second adjustable air directing means positioned respectively in said first and second outlet openings, each of said air directing means being operable to direct a stream of air issuing therefrom in a selected direction, said first and second air directing means being so oriented with respect to one another that the streams of air issuing therefrom are focused upon a selected area, and control means connected to both said first and second air directing means for conjointly adjusting said air directing means for altering the direction of flow of the airstreams issuing therefrom, said control means maintaining a fixed relationship between said first and second air directing means so that the airstreams issuing therefrom both continue to be directed toward a selected area.

2. The device of claim 1 wherein said first and second air directing means comprises respectively first and second louvers, and wherein said control means comprises means connecting said first and second louvers together, said control means maintaining a fixed angular relationship between said first and second louvers.

3. The device of claim 2 wherein each of said louvers is positionable over a full range between a first position substantially closing said outlet opening and a second position opening said outlet opening, said first louver being in said second position when said second louver is in said first position, and said second louver being in said second position when said first louver is in said second position.

4. The device of claim 3 wherein said first and second outlets are at right angles to one another.

5. The device of claim 1 wherein said first and second air directing means each comprise respectively first and second sets of louvers, the louvers of each set being connected together, and wherein said control means comprises operating members interconnected between said first and second sets of louvers to operate said louvers in an interrelated manner so that the angular relationship between said sets of louvers is maintained during movement of said louvers.

6. The device of claim 1 wherein said box is rotatably movable with respect to said air supply system.

7. An air discharge device for use with an air supply system comprising;

an outlet box having means for rotatably securing it to be rotatable with respect to the air supply system through 360° of rotation, first and second outlet openings in said outlet box spaced from one another and disposed at a predetermined angle to one another, first and second adjustable air directing means positioned respectively in said first and second outlet openings, each of said air directing means being operable to direct a stream of air issuing therefrom in a selected direction, said first and second air directing means being so oriented with respect to one another that the streams of air issuing therefrom are focused upon a selected area, and control means connected to both said first and second air directing means for conjointly adjusting said air directing means for altering the direction of flow of the air streams issuing therefrom, said control means maintaining a fixed relationship between said first and second air directing means so that the air streams issuing therefrom both continue to be directed toward a selected area.

* * * * *